US006885264B1

(12) United States Patent
Vincent et al.

(10) Patent No.: US 6,885,264 B1
(45) Date of Patent: Apr. 26, 2005

(54) MEANDERED-LINE BANDPASS FILTER

(75) Inventors: Perry F. Vincent, Zephyrhills, FL (US); James W. Culver, Seminole, FL (US); Steve D. Eason, Largo, FL (US)

(73) Assignee: Raytheon Company, Waltham, MA (US)

( * ) Notice: Subject to any disclaimer, the term of this patent is extended or adjusted under 35 U.S.C. 154(b) by 97 days.

(21) Appl. No.: 10/383,367

(22) Filed: Mar. 6, 2003

(51) Int. Cl.[7] ..... H01P 1/203
(52) U.S. Cl. ..... 333/204; 333/202
(58) Field of Search ..... 333/14, 213, 202, 333/204, 216, 217

(56) References Cited

U.S. PATENT DOCUMENTS

| | | | | |
|---|---|---|---|---|
| 3,320,556 A | | 5/1967 | Schneider | 333/34 |
| 3,419,813 A | | 12/1968 | Kamnitsis | 330/30 |
| 3,530,479 A | | 9/1970 | Waldron | 343/771 |
| 3,745,489 A | * | 7/1973 | Cristal et al. | 333/185 |
| 4,214,217 A | | 7/1980 | Saito et al. | 334/45 |
| 4,254,386 A | | 3/1981 | Nemit et al. | 333/128 |
| 4,310,814 A | | 1/1982 | Bowman | 333/121 |
| 4,394,633 A | | 7/1983 | Klein | 333/238 |
| 4,614,922 A | | 9/1986 | Bauman et al. | 333/161 |
| 4,647,880 A | | 3/1987 | Argaman | 333/164 |
| 4,710,775 A | | 12/1987 | Coe | 343/727 |
| 4,757,287 A | * | 7/1988 | Grandfield et al. | 333/205 |

(Continued)

FOREIGN PATENT DOCUMENTS

| | | | |
|---|---|---|---|
| EP | 0 317 414 A1 | 5/1989 | H01Q/21/24 |
| EP | 0 508 662 A2 | 10/1992 | H01P/5/12 |
| EP | 0 801 433 A1 | 10/1997 | H01P/3/08 |
| EP | 1 022 803 A | 7/2000 | H01Q/9/04 |
| JP | 63281502 | 11/1988 | H01P/5/08 |

OTHER PUBLICATIONS

PCT International Search Report dated Aug. 6, 2001 for PCT/US01/11410 filed Apr. 6, 2001.

PCT International Search Report dated Jul. 18, 2002 for PCT/US02/15646 filed May 15, 2002.

PCT International Search Report dated Sep. 17, 2001 for PCT/US02/40512 filed Apr. 12, 2001.

Mosko, United States Statutory Invention Registration H27, "Integrable Broadside Power Divider," filed Sep. 3, 1985, published Feb. 4, 1986.

Saito et al, XP–002172854, "UHF TV Tuner Using PC Board with Suspended Striplines," IEEE Transactions on Consumer Electronics, vol. CE–24, No. 4, pp. 553–559, Nov. 1978.

Peter et al, "High–Performance HEMT Amplifiers with a Simple Low–Loss Matching Network," IEEE Transactions on Microwave Theory and Techniques, vol. 39, 01, New York, US, pp. 1673–1675, Sep. 1, 1991.

Wilkinson, "An N–Way Hybrid Power Divider," IRE Transactions on Microwave Theory and Techniques, vol. MTT–8, No. 1, pp. 116–118, Jan. 1960.

Pozar, D.M., "Microwave Engineering," John Wiley & Sons, Inc., Second Edition, pp. 363–368, 1998.

Gong et al., "Characterization of Cavity–Backed Comformal Antennas and Arrays Using a Hybrid Finite Element Method with Tetrahedral Elements," The University of Michigan, Ann Arbor, Michigan, pp. 1629–1632, 1992.

(Continued)

*Primary Examiner*—Timothy P. Callahan
*Assistant Examiner*—An T. Luu
(74) *Attorney, Agent, or Firm*—Baker Botts L.L.P.

(57) ABSTRACT

A meandered-line bandpass filter includes a parallel coupled line bandpass filter that has a length and one or more corners. Each of the corners is associated with a reactance that affects the propagation of an electromagnetic wave along the length of the parallel coupled line bandpass filter.

25 Claims, 5 Drawing Sheets

U.S. PATENT DOCUMENTS

| | | | | | |
|---|---|---|---|---|---|
| 4,772,864 | A | | 9/1988 | Otto et al. | 333/238 |
| 4,833,485 | A | | 5/1989 | Morgan | 343/895 |
| 4,853,660 | A | * | 8/1989 | Schloemann | 333/204 |
| 4,916,457 | A | | 4/1990 | Foy et al. | 373/770 |
| 4,945,319 | A | | 7/1990 | Wilson | 333/33 |
| 4,958,165 | A | | 9/1990 | Axford et al. | 343/770 |
| 4,987,377 | A | | 1/1991 | Gray et al. | 330/54 |
| 5,021,755 | A | | 6/1991 | Gustafson | 333/128 |
| 5,030,935 | A | | 7/1991 | Williams et al. | 333/246 |
| 5,187,490 | A | | 2/1993 | Ohta et al. | 343/770 |
| 5,200,719 | A | | 4/1993 | Margulis et al. | 333/34 |
| 5,293,175 | A | | 3/1994 | Hemmie et al. | 343/795 |
| 5,444,453 | A | | 8/1995 | Lalezari | 343/700 MS |
| 5,471,181 | A | | 11/1995 | Park | 333/246 |
| 5,581,266 | A | | 12/1996 | Peng et al. | 343/770 |
| 5,712,607 | A | | 1/1998 | Dittmer et al. | 333/238 |
| 5,760,744 | A | | 6/1998 | Sauer | 343/700 MS |
| 5,767,808 | A | | 6/1998 | Robbins et al. | 349/700 |
| 5,789,997 | A | | 8/1998 | Dekker | 333/127 |
| 5,815,122 | A | | 9/1998 | Nurberger et al. | 343/767 |
| 5,872,545 | A | | 2/1999 | Rammos | 343/770 |
| 5,914,695 | A | | 6/1999 | Liu et al. | 343/795 |
| 5,926,150 | A | | 7/1999 | McLean et al. | 343/846 |
| 5,945,962 | A | | 8/1999 | Harrington et al. | 343/792.5 |
| 5,946,794 | A | | 9/1999 | Koizumi et al. | 29/600 |
| 6,061,032 | A | | 5/2000 | Sandstedt et al. | 343/770 |
| 6,081,988 | A | | 7/2000 | Pluymers et al. | 29/601 |
| 6,140,975 | A | | 10/2000 | Cohen | 343/846 |
| 6,208,306 | B1 | | 3/2001 | McLean et al. | 343/747 |
| 6,400,322 | B2 | | 6/2002 | Fang et al. | 343/700 MS |
| 6,452,553 | B1 | | 9/2002 | Cohen | 343/702 |
| 6,507,320 | B2 | | 1/2003 | Von Stein et al. | 343/770 |
| 6,518,844 | B1 | | 2/2003 | Sherman et al. | 330/286 |
| 6,535,088 | B1 | | 3/2003 | Sherman et al. | 333/238 |
| 6,542,048 | B1 | | 4/2003 | Sherman et al. | 333/128 |
| 6,552,635 | B1 | | 4/2003 | Sherman et al. | 333/238 |
| 2002/0122009 | A1 | | 9/2002 | Winebrand et al. | |

OTHER PUBLICATIONS

Auckland et al., "A Procedure to Calculate the in–situ Contribution to Body Scattering Caused by Conformal Cavity–Backed Apertures," Atlantic Aerospace Electronics Corp., Greenbelt, Maryland, pp. 1764–1767, 1995.

Baudou et al., "Analysis of a Conformal Cavity–Backed Patch Antenna Using a Hybrid MoM/FEM Technique," Université Paul Sabatier, Cedex, France, pp. 354–357, 2001.

Bailey, "Broad–Band Half–Wave Dipole," IEEE Transactions on Antennas and Propagation, vol. AP–32, No. 4, cover page and pp. 410–412, Apr. 2000.

Gianvittorio et al., "Fractal Loop Elements in Phased Array Antennas: Reduced Mutual Coupling and Tighter Packing," IEEE 0–7803–6345–0/00, 2000, pp. 315–318.

Saleh, A.A.M., "Planar Electrically Symmetric n–Way Hybrid Power Dividers/Combiners," IEEE Transactions on Microwave Theory and Techniques, vol. MTT–28, No. 6, pp. 555–563, Jun. 1980.

Green, H.E., "The Numerical Solution of Some Important Transmission–Line Problems," IEEE Transactions on Microwave Theory and Techniques, vol. MTT–13, No. 5, pp. 676–692, Sep. 1965.

Fromm, W.E., "Characteristics and Some Applications of Stripline Components," IEEE Transactions on Microwave Theory and Techniques, vol. MTT–3, No. 2, pp. 13–19, Mar. 1955.

Saleh, A.A.M., "Computation of the Frequency Response of a Class of Symmetric N–Way Power Dividers," Bell System Technical Journal, vol. 59, No. 8, pp. 1493–1512, Oct. 1980.

Qian et al., "Progress in Active Integrated Antennas and Their Applications," IEEE Transactions on Microwave Theory and Techniques, vol. 46, No. 11, pp. 1891–1900, Nov. 1998.

Yarovoy, et al., "Ultra–Wideband Antennas for Ground Penetrating Radar," International Research Centre for Telecommunications–Transmission and Radar, Delft, The Netherlands, 5 unnumbered pages, date unknown.

"Ninth Progress Report on the Research Project Improved Ground Penetrating Radar Technology," Delft University of Technology, Delft, The Netherlands, 6 unnumbered pages, date unknown.

Radzevicius, et al., "Pitfalls in GPR Data Interpretation: Differentiating Stratigraphy and Buried Objects from Periodic Antenna and Target Effects," Geophysical Research Letters, vol. 27, No. 20, Ohio State University, Columbus, Ohio, pp. 3393–3396, Oct. 15, 2000.

Lestari, et al., "Capacitively–Tapered Bowtie Antenna", International Research Centre for Telecommunications–Transmission and Radar, Delft, The Netherlands, 4 unnumbered pages, date unknown.

Kempel, et al., "Radiation by Cavity–Backed Antennas on a Circular Cylinder," IEEE Proceedings—Microwave Antennas Propagation., vol. 142, No. 3, Jun. 1995, pp 233–239.

Eason, U.S. Appl. No. 10/146,455, entitled "Fractal Cross Slot Antenna," 25 pages, (064750.0449) May 14, 2002.

Sherman et al., U.S. Appl. No. 09/548,689, entitled "Method for Fabricating Suspended Transmission Line," 23 pages (064750.0424) Apr. 13, 2000.

Eason et al., U.S. Appl. No. 10/352,264, entitled "Compact Antenna Element and Array, and a Method of Operating Same," 23 pages (064750.0456) Apr. 13, 2000.

* cited by examiner

MEANDERED-LINE BANDPASS FILTER

TECHNICAL FIELD OF THE INVENTION

This invention relates generally to bandpass filters and more particularly to meandered-line bandpass filters.

BACKGROUND OF THE INVENTION

An edge-coupled microstrip transmission line filter can be used to implement a bandpass filter. However, an edge-coupled microstrip transmission line filter causes spurious, repeating passbands at the harmonic frequencies of the filter, which cause noise that can adversely affect devices near the filter. A low pass filter can be cascaded from the edge-coupled microstrip transmission line filter to reduce this noise, but the additional filter only reduces noise associated with the first harmonic frequency of the edge-coupled microstrip transmission line filter, while increasing the size and loss of the bandpass filter and contributing to noise associated with other frequencies. A uniplanar compact photonic-bandgap structure can be used as a ground plane in the edge-coupled microstrip transmission line filter to introduce a periodic disturbance that rejects the spurious passbands of the edge-coupled microstrip transmission line filter, but this structure is difficult to realize, since it must be isolated from other ground conductors to be effective. Modulating, in a sinusoidal pattern, the strip widths of a parallel-coupled transmission-line filter having a constant ground plane can reduce passband harmonics, but at the cost of insertion loss in the passband.

SUMMARY OF THE INVENTION

Particular embodiments of the present invention may reduce or eliminate disadvantages and problems traditionally associated with with bandpass filters.

In one embodiment of the present invention, a meandered-line bandpass filter includes a parallel coupled line bandpass filter that has a length and one or more corners. Each of the corners is associated with a reactance that affects the propagation of an electromagnetic wave along the length of the parallel coupled line bandpass filter. In a more particular embodiment, the parallel coupled line bandpass filter includes a fractal curve along the length of the parallel coupled line bandpass filter.

Particular embodiments of the present invention provide one or more advantages. Particular embodiments can suppress the response of a bandpass filter in a second harmonic passband of the bandpass filter without shifting the integrity of the response of the bandpass filter or otherwise significantly compromising the integrity of the shape of the passband of the bandpass filter. Particular embodiments can increase the bandwidth of a bandpass filter. Particular embodiments can provide more efficient packing of the conductive elements of a bandpass filter.

Certain embodiments provide all, some, or none of these technical advantages, and certain embodiments provide one or more other technical advantages readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description, taken in conjunction with the accompanying drawings, in which.

DESCRIPTION OF EXEMPLARY EMBODIMENTS

Figure 1:
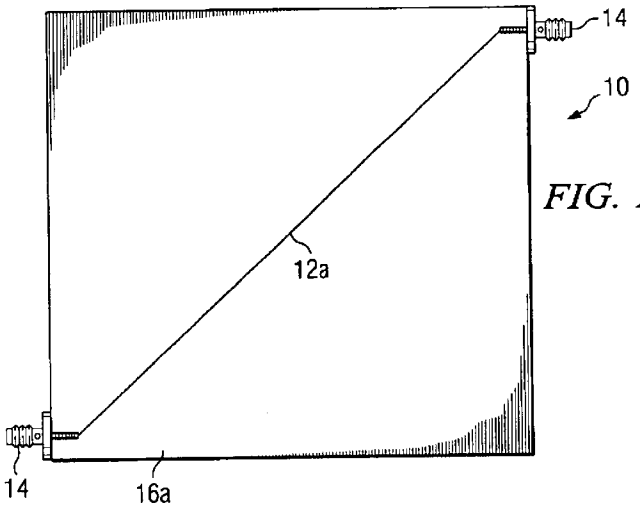
FIG. 1 illustrates an exemplary straight-line bandpass filter.

FIG. 1 illustrates an exemplary straight-line bandpass filter 10. Straight-line bandpass filter 10 is a parallel coupled line microstrip filter that includes a strip 12 coupling two connectors 14 to each other. Substrate 16*a* comprises FR-4, and strip 12*a* comprises copper. Although substrate 16*a* is described as including FR-4, substrate 16*a* might comprise any suitable material. Although strip 12*a* is described as including copper, strip 12*a* might also comprise any suitable material. The effective length of straight-line bandpass filter 10 is approximately 6.5 inches. Reference to the effective length of a filter includes the length of the filter from one end of the filter to the other in a straight line. Straight-line bandpass filter 10 might be used in any of a number of different applications. As an example, straight-line bandpass filter 10 might be used in a communications system to filter out certain signals received by an antenna. Although strip 12*a* appears to be a single strip of conductive material, strip 12*a* comprises four staggered sections 18 that run parallel to each other, as described more fully below.

Figure 2:
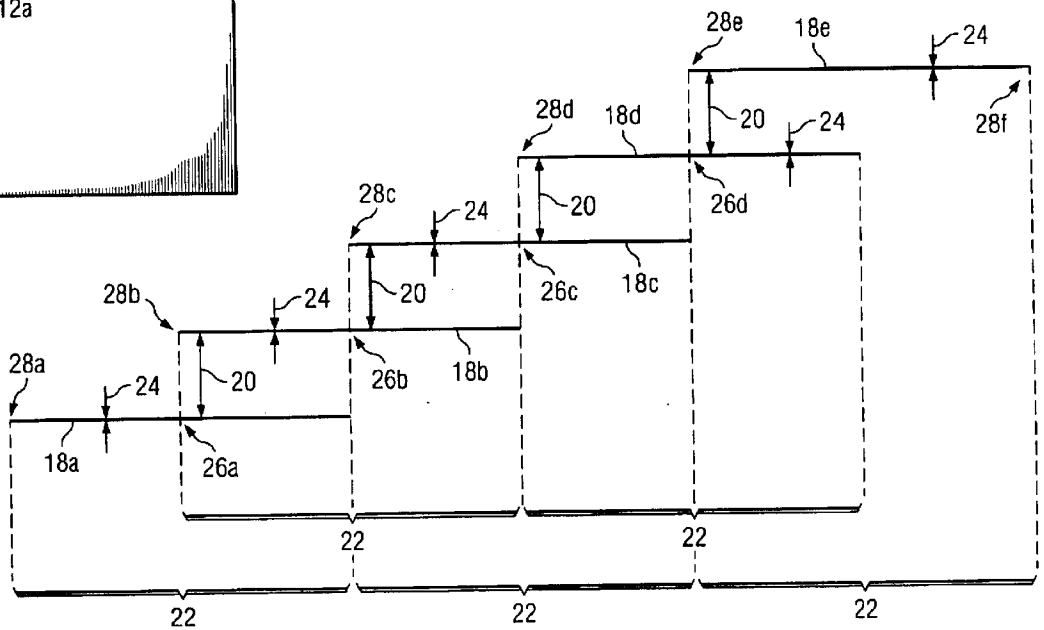
FIG. 2 illustrates exemplary sections of the straight-line bandpass filter illustrated in FIG. 1.

FIG. 2, which is not necessarily drawn to scale, illustrates exemplary sections 18 of straight-line bandpass filter 10. Each section 18 of straight-line bandpass filter 10 is more or less straight. Sections 18 of straight-line bandpass filter 10 comprise copper. Straight-line bandpass filter 10 is a four-fold filter that comprises five sections 18. Sections 18*a* and 18*e* are launches at which signals can be introduced to straight-line bandpass filter 10. End 28*a* of section 18*a* is coupled to one connector 14, and end 28*f* of section 18*e* is coupled to another connector 14. Sections 18*b*, 18*c*, and 18*d* are filter resonators. Although straight-line bandpass filter 10 is described and illustrated as including a particular number of sections 18, straight-line bandpass filter 10 might comprise any suitable number of sections 18. Sections 18 run parallel to each other, and two sections 18 that are adjacent to each other are separated from each other in a direction perpendicular to sections 18 by a distance 20 of approximately 0.008 inches. Each section 14 has a length 22 of approximately 2.4 inches and a width 24 of approximately 0.005 inches. Midpoint 26*a* of section 18*a* is approximately even with end 28*b* of section 18*b*, midpoint 26*b* of section 18*b* is approximately even with end 28*c* of section 18*c*, midpoint 26*c* of section 18*c* is approximately even with end 28*d* of section 18*d*, and midpoint 26*d* of section 18*d* is approximately even with end 28*e* of section 18*e*.

Although two sections 18 of straight-line bandpass filter 10 that are adjacent each other are described and illustrated as being separated from each other by a particular distance 20, two sections 18 of straight-line bandpass filter 10 that are adjacent each other might be separated from each other by any suitable distance 20. In addition, a first distance 20 separating a first pair of adjacent sections 18 of straight-line bandpass filter 10 from each other might be approximately the same as or different from a second distance 20 separating a second pair of adjacent sections 18 of straight-line bandpass filter 10 from each other. Although a section 18 of straight-line bandpass filter 10 is described and illustrated as having a particular length 22, section 18 might have any suitable length 22. In addition, a first length 22 of a first section 18 of straight-line bandpass filter 10 might be approximately the same as or different from a second length 22 of a second section 18 of straight-line bandpass filter 10. Although a section 18 of straight-line bandpass filter 10 is described and illustrated as having a particular width 24, section 18 might have any suitable width 24. In addition, a first width 24 of a first section 18 of straight-line bandpass filter 10 might be approximately the same as or different from a second width 24 of a second section 18 of straight-line bandpass filter 10. In addition, a first width 24 of a first section 18 of straight-line bandpass filter 10 might be approximately the same as or different from a second width 24 of a second section 18 of straight-line bandpass filter 10.

Waves travel along strip 12*a* of straight-line bandpass filter 10 from one section 18 to another, and the phase velocity of an odd-mode wave as it travels along strip 12*a* of straight-line bandpass filter 10 is greater than the phase velocity of an even-mode wave as it travels along straight-line bandpass filter 10. Because the phase velocities of odd-mode waves are greater than the phase velocities of even-mode waves, the response of straight-line bandpass filter 10 includes a harmonic passband at twice the resonant frequency of straight-line bandpass filter 10 that might adversely affect one or more devices near straight-line bandpass filter 10. As described below, a fractal curve 30 can be used to meander straight-line bandpass filter 10 to suppress the response of straight-line bandpass filter 10 in the second harmonic passband.

Figure 3:
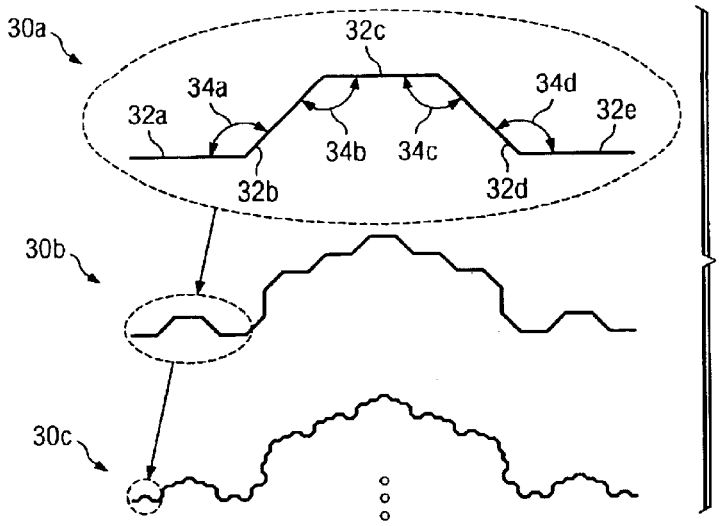
FIG. 3 illustrates an exemplary fractal curve that can be used to meander the straight-line bandpass filter illustrated in FIG. 1.

FIG. 3 illustrates an exemplary fractal curve 30 that can be used to meander straight-line bandpass filter 10. Fractal curves have been applied to antenna elements to reduce the effective lengths of the antenna elements without significantly reducing performance of the antenna elements. Application of fractal curves to the antenna elements also increases the lengths of the conductor paths of the antenna elements and enhances the bandwidths of the antennas. Fractal curve 30*a* is a modified version of a Koch curve that includes five segments 32. Fractal curve 30*a* is a first iteration of fractal curve 30*a* Reference to a first iteration of a fractal curve 30 includes an iteration of fractal curve 30 that does not necessarily include any self-repeating portions.

Each segment 32 is more or less straight and, at one or each of both of its ends, joined to another segment 32 at an inside angle 34. Line segment 32*a* is joined at one end to line segment 32*a* at inside angle 34*a*, line segment 32*b* is joined at one end to line segment 32*a* at inside angle 34*a* and joined at the other end to line segment 32*c* at inside angle 34*b*, line segment 32*c* is joined at one end to line segment 32*b* at inside angle 34*b* and joined at the other end to line segment 32*d* at inside angle 34*c*, line segment 32*d* is joined at one end to line segment 32*c* at inside angle 34*c* and joined at the other end to line segment 32*e* at inside angle 34*d*, and line segment 32*e* is joined at one end to line segment 32*d* at inside angle 34*d*. Each inside angle 34 is equal to approximately 135 degrees.

Fractal curve 30*b* is a second iteration of fractal curve 30*a* that has been generated by replacing each segment 32 of fractal curve 30*a* with fractal curve 30*a*. Fractal curve 30*b* includes twenty-five segments 28. Fractal curve 30*c* is a third iteration of fractal curve 30*a* that has been generated by replacing each segment 32 of fractal curve 30*b* with fractal curve 30*a*. Fractal curve 30*c* includes 125 segments 28. Further iterations of fractal curve 30*a* can be generated. Although particular iterations of a particular fractal curve 30 have been described and illustrated, the present invention contemplates any suitable number of iterations of any suitable fractal curve 30. A fractal curve 30 can include two or more segments 32 and need not include a number of segments 32 that is a multiple of five. In addition, the length of a first segment 32 of a fractal curve 30 can be approximately the same as or different from the length of a second segment 32 of fractal curve 30. As another example, a fractal curve 30 can include any suitable inside angles 34 between zero and 180 degrees. In addition, a first inside angle 34 of a fractal curve 30 can be approximately the same as or different from a second inside angle 34 of fractal curve 30.

Figure 4A:
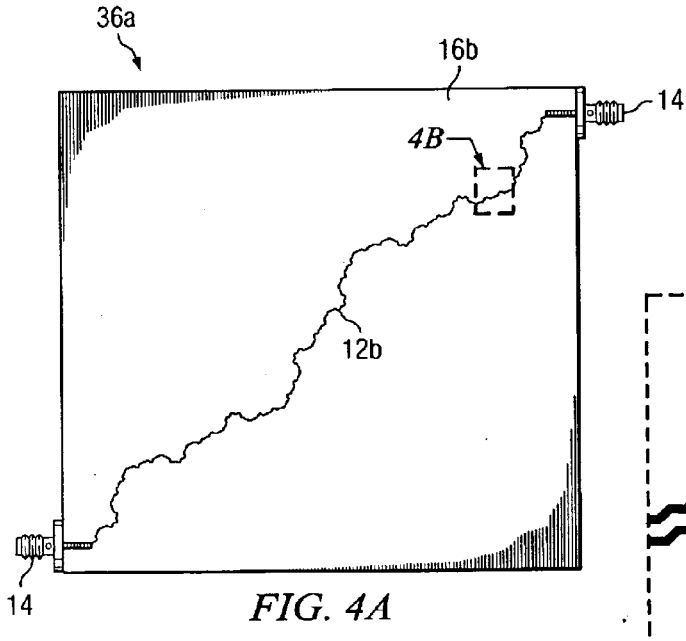
FIGS. 4A and 4B illustrates an exemplary meandered-line bandpass filter.

FIG. 4A illustrates an exemplary meandered-line bandpass filter 36*a* Meandered-line bandpass filter 36*a* is also a parallel coupled line microstrip filter that includes a strip 12 coupling two connectors 14 to each other. Conventional design equations that can be used to design straight-line bandpass filter 10 can be used to design meandered-line bandpass filter 36*a* such that the center frequency and the bandwidth of meandered-line bandpass filter 36*a* are approximately equal to the center frequency and the bandwidth of straight-line bandpass filter 10, respectively. Substrate 16*b* comprises FR-4 and has a dielectric constant of approximately 4.5, a thickness of approximately 0.062 inches, and a loss tangent of approximately 0.01. Although substrate 16*b* is described as including a particular material and having a particular dielectric constant, a particular thickness, and a particular loss tangent, substrate 16*b* could comprise any suitable material and have any suitable dielectric constant, any suitable thickness, and any suitable loss tangent. Strip 12*b* comprises copper. Although strip 12*b* is described as including copper, strip 12*b* could comprise any suitable material. The effective length of meandered-line bandpass filter 36*a* is approximately 4.875 inches. Although meandered-line bandpass filter 36*a* is described as having a particular effective length, meandered-line bandpass filter 36*a* can have any suitable effective length.

Figure 4B:
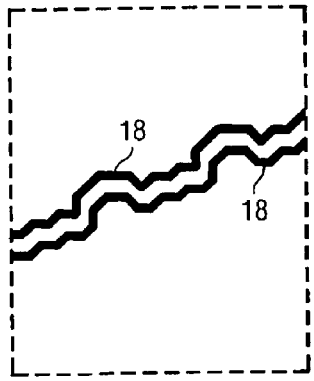

Strip 12*b* comprises four sections 18 that run parallel to each other, and each section 18 of strip 12*b*, instead of being more or less straight, has been meandered according to fractal curve 30*c*. FIG. 4B illustrates a portion of strip 12*b* in detail. The portion of strip 12*b* illustrated in FIG. 4*b* comprises two sections 18. Both sections 18 have been meandered according to fractal curve 30*c*. Each section 18 of meandered-line bandpass filter 36*a* has a width 24 of approximately 0.005 inches and is separated from an adjacent section 18 by a distance 20 of approximately 0.008 inches. To accommodate fractal bending, meandered-line bandpass filter 36*a* has been designed such that widths 24 are relatively narrow and distances 20 are relatively short.

Although two sections 18 of meandered-line bandpass filter 36*a* that are adjacent to each other are described and illustrated as being separated from each other by a particular distance 20, two sections 18 of meandered-line bandpass filter 36*a* that are adjacent to each other could be separated from each other by any suitable distance 20. In addition, a first distance 20 separating a first pair of adjacent sections 18 of meandered-line bandpass filter 36*a* from each other could be approximately the same as or different from a second distance 20 separating a second pair of adjacent sections 18 of meandered-line bandpass filter 36*a* from each other. Although a section 18 of meandered-line bandpass filter 36*a* is described and illustrated as having a particular length 22, section 18 could have any suitable length 22. In addition, a first length 22 of a first section 18 of meandered-line bandpass filter 36*a* could be approximately the same as or different from a second length 22 of a second section 18 of meandered-line bandpass filter 36*a*. Although a section 18 of meandered-line bandpass filter 36*a* is described and illustrated as having a particular width 24, section 18 could have any suitable width 24. In addition, a first width 24 of a first section 18 of meandered-line bandpass filter 36*a* could be approximately the same as or different from a second width 24 of a second section 18 of meandered-line bandpass filter 36*a*. In addition, a first width 24 of a first section 18 of meandered-line bandpass filter 36*a* could be approximately the same as or different from a second width 24 of a second section 18 of meandered-line bandpass filter 36*a*.

A corner includes an angular joint between two more or less straight portions of a strip 12. A portion of a strip 12 that is more or less near a corner need not be perfectly straight, and the corner need not be perfectly angular. The present invention contemplates a portion of a strip 12 that is more or less near a corner being rounded to some degree. A portion of a strip 12 that is more or less near a corner could be rounded to some degree as a result of limitations associated with equipment, one or more techniques, or both used to fabricate a meandered-line bandpass filter 36. Each corner in a strip 12 creates a reactance between the two more or less straight portions of strip 12 on either side of the corner. A strip 12 can include one or more corners, and the one or more reactances created by the corners tend to equalize the phase velocities of odd-mode waves with the phase velocities of even-mode waves traveling along strip 12 from one section 18 of strip 12 to another, which tends to suppress the response of meandered-line bandpass filter 36 in the second harmonic passband of meandered-line bandpass filter 36.

Each fractal bend in strip 12*b* includes a corner that creates a reactance between a first segment 32 on one side of the fractal bend and a second segment 32 on the other side of the fractal bend. Reference to a fractal bend can include an inside angle 34 of a fractal curve 30. The reactance created by the fractal bends in strip 12*b* tend to equalize the phase velocities of odd-mode waves with the phase velocities of even-mode waves traveling along strip 12*b* from one section 18 to another, which tends to suppress the response of meandered-line bandpass filter 36*a* in the second harmonic passband of meandered-line bandpass filter 36*a*.

One or more of the reactances created by the fractal bends in strip 12*b* can be increased to increase the suppression of the response of meandered-line bandpass filter 36*a* in the second harmonic passband. One technique for increasing one or more of the reactances includes decreasing one or more inside angles 34 along strip 12*b*. In particular embodiments, an inside angle 34 cannot be less than or approximately equal to ninety degrees. In these embodiments, an inside angle 34 of less than or approximately equal to ninety degrees could cause strip 12*b* to bend back onto itself, creating a short circuit. In particular embodiments, limitations associated with equipment, one or more techniques, or both used to fabricate a meandered-line bandpass filter 36 could also limit an inside angle 34. In particular embodiments, an inside angle 34 of 135 degrees can be used. Another technique for increasing one or more of the reactances includes, at each of one or more of the fractal bends along strip 12*b*, increasing the dielectric constant between a first segment 32 on one side of the fractal bend and a second segment 32 on the other side of the fractal bend. To increase the dielectric constant between a first segment 32 on one side of a fractal bend and a second segment 32 on the other side of the fractal bend, one or more portions of strip 12*b* could be embedded, fully or to a degree, in a material that has a higher dielectric constant. Although particular techniques are described for increasing the reactance created by the fractal bends in strip 12*b*, the present invention contemplates any suitable technique for increasing the reactance created by the fractal bends in strip 12*b*.

Fractal bending facilitates a more efficient packing of the conductor and gives rise to a distributed reactive loading. Each bend of the fractal structure increase conductor length and represents a discontinuity in the charge-carrying path. Electrically, these discontinuities appear to be either capacitative or inductive, thus creating a distributed reactive loading effect. This loading serves to slow a propagating wave and thereby reduce the effective wavelength of the propagating wave without significantly shifting its frequency response.

Modulation introduces a periodic disturbance that rejects the harmonic passbands and acts as a slow wave structure that reduces the total physical size of the parallel-coupled line microstrip filter. The slow wave effect is stronger in the even mode of the coupled lines and weaker in the odd modes. The difference in even and odd mode phase velocities in coupled line filters creates a harmonic passband that occurs at twice the resonant frequency. In the classical straight-coupled line filter, the phase velocity of the odd mode is faster than the even mode. Since the odd-mode current densities tend to gather around the edge of the coupled side of the resonators, it is advantageous to physically or electrically lengthen the coupled side of the resonator relative to the outer edge of the conductor effecting the phase velocity. To compensate for the phase velocity differential, the coupled lines can be bent in a fractal shape to allow the electrical length of the even and odd modes to be similar.

Figure 5:
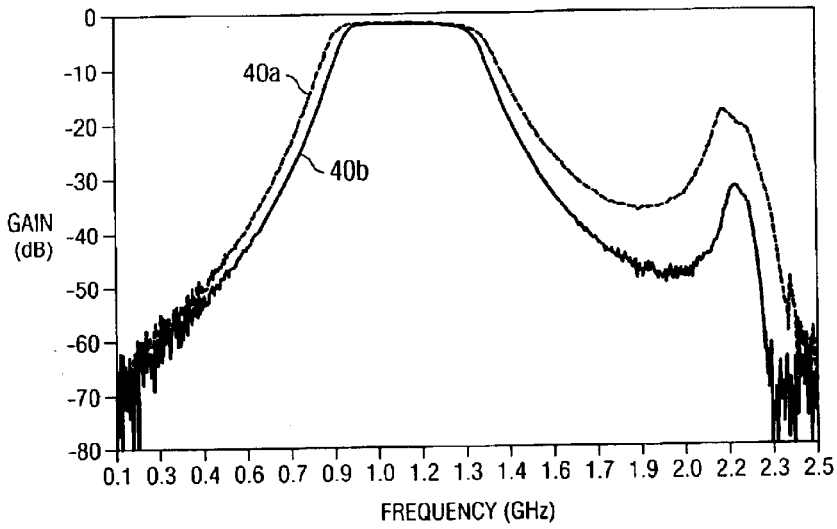
FIG. 5 illustrates an exemplary response of the meandered-line bandpass filter illustrated in FIG. 4.

FIG. 5 illustrates an exemplary response of meandered-line bandpass filter 36*a*. Trace 40*a* indicates the response of straight-line bandpass filter 10, and trace 40*b* indicates the response of meandered-line bandpass filter 36*a*. According to trace 40*a* and trace 40*b*, straight-line bandpass filter 10 and meandered-line bandpass filter 36*a* both have a first passband that has a lower limit of approximately 0.9 GHz and an upper limit of approximately 1.35 GHz. Straight-line bandpass filter 10 and meandered-line bandpass filter 36*a* also both have a second passband at the second harmonic that lies between approximately 2.1 GHz and approximately 2.25 GHz. The attenuation of the response of meandered-line bandpass filter 36*a* in the second passband is approximately equal to 56%, which is significantly greater than the attenuation of the response of straight-line bandpass filter 10 in the second passband.

Figure 6A:
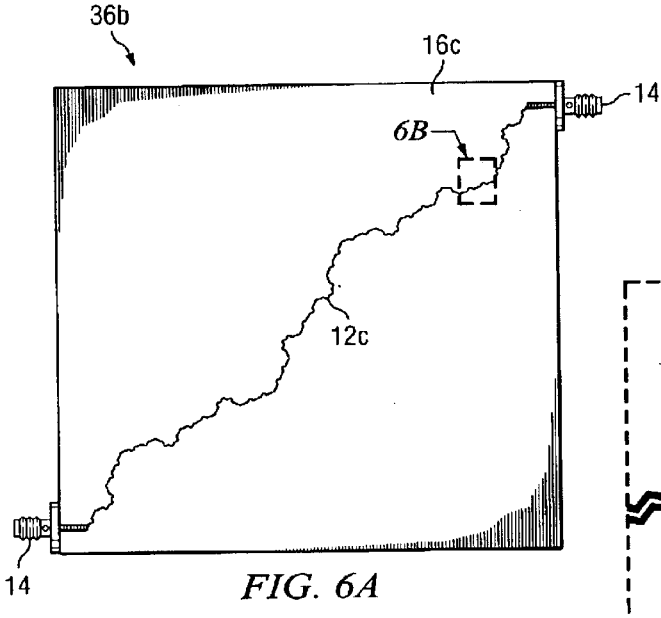
FIGS. 6A and 6B illustrates another exemplary meandered-line bandpass filter.

FIG. 6A illustrates another exemplary meandered-line bandpass filter 36*b*. Meandered-line bandpass filter 36*a* is also a parallel coupled line microstrip filter that includes a strip 12 coupling two connectors 14 to each other. Substrate 16*c* comprises FR4 and has a dielectric constant of approximately 4.5, a thickness of approximately 0.062 inches, and a loss tangent of approximately 0.01. Although substrate 16*c* is described as including a particular material and having a particular dielectric constant, a particular thickness, and a particular loss tangent, substrate 16*c* could comprise any suitable material and have any suitable dielectric constant, any suitable thickness, and any suitable loss tangent. Strip 12*c* comprises copper. Although strip 12*c* is described as including copper, strip 12*c* could comprise any suitable material.

Figure 6B:
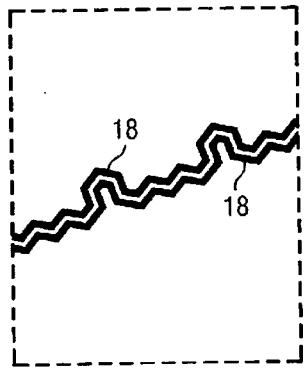

Strip 12*c* comprises four sections 18 that run parallel to each other, and each section 18 of strip 12*c* has been meandered according to a fractal curve 30 that is similar to fractal curve 30*c*, but that includes inside angles 34 that are each approximately equal to 120 degrees. FIG. 6B illustrates a portion of strip 12*c* in detail. The portion of strip 12*c* illustrated in FIG. 6B comprises two sections 18. Both sections 18 have been meandered according to fractal curve 30. Like each section 18 of meandered-line bandpass filter 36*a*, each section 18 of meandered-line bandpass filter 36*b* has a width 24 of approximately 0.005 inches and is separated from an adjacent section 18 by a distance 20 of approximately 0.008 inches.

Although two sections 18 of meandered-line bandpass filter 36*b* that are adjacent to each other are described and illustrated as being separated from each other by a particular distance 20, two sections 18 of meandered-line bandpass filter 36*b* that are adjacent to each other could be separated from each other by any suitable distance 20. In addition, a first distance 20 separating a first pair of adjacent sections 18 of meandered-line bandpass filter 36*b* from each other could be approximately the same as or different from a second distance 20 separating a second pair of adjacent sections 18 of meandered-line bandpass filter 36*b* from each other. Although a section 18 of meandered-line bandpass filter 36*b* is described and illustrated as having a particular length 22, section 18 could have any suitable length 22. In addition, a first length 22 of a first section 18 of meandered-line bandpass filter 36*b* could be approximately the same as or different from a second length 22 of a second section 18 of meandered-line bandpass filter 36*b*. Although a section 18 of meandered-line bandpass filter 36*b* is described and illustrated as having a particular width 24, section 18 could have any suitable width 24. In addition, a first width 24 of a first section 18 of meandered-line bandpass filter 36*b* could be approximately the same as or different from a second width 24 of a second section 18 of meandered-line bandpass filter 36*b*. In addition, a first width 24 of a first section 18 of meandered-line bandpass filter 36*b* could be approximately the same as or different from a second width 24 of a second section 18 of meandered-line bandpass filter 36*b*.

Figure 7:
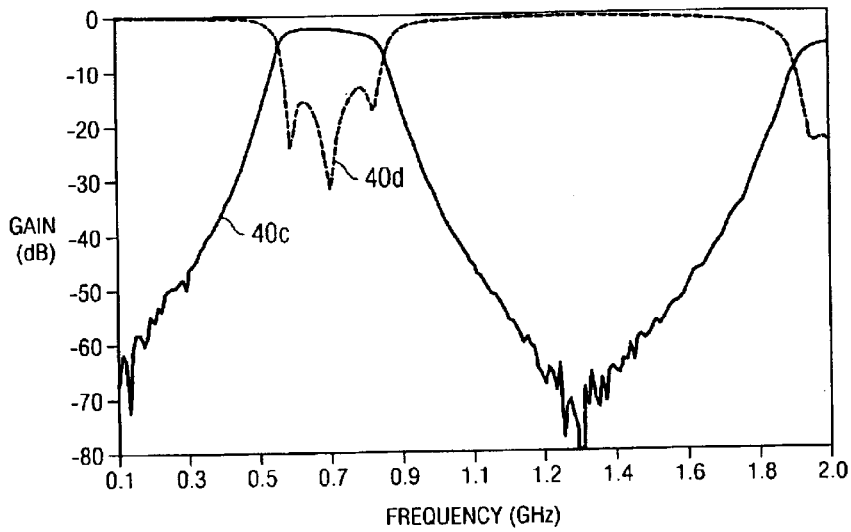
FIG. 7 illustrates an exemplary response of the meandered-line bandpass filter illustrated in FIG. 6.

FIG. 7 illustrates an exemplary response of meandered-line bandpass filter 36*b*. Trace 40*c* indicates the insertion loss of meandered-line bandpass filter 36*b*, and trace 40*d* indicates the return loss of meandered-line bandpass filter 36*b*. According to trace 40*c*, meandered-line bandpass filter 36*b* has a passband that has a lower limit of approximately 0.55 GHz and an upper limit of approximately 0.85 GHz. The response of meandered-line bandpass filter 36*b* at the second harmonic lies between approximately 1.25 GHz and approximately 1.35 GHz, and the rejection at the second harmonic passband is approximately equal to 70 dB.

Figure 8A:
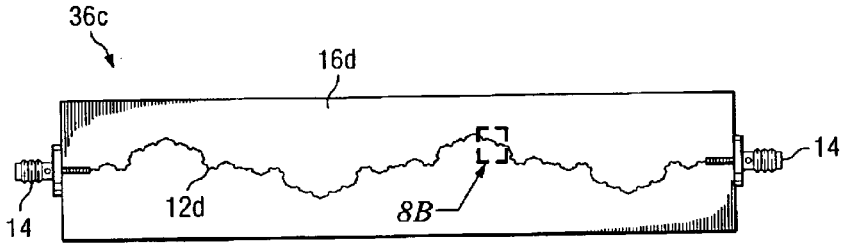
FIGS. 8A and 8B illustrates another exemplary meandered-line bandpass filter.

FIG. 8A illustrates another exemplary meandered-line bandpass filter 36*c*. Meandered-line bandpass filter 36*c* is also a parallel coupled line microstrip filter that includes a strip 12 coupling two connectors 14 to each other. Substrate 16*d* comprises Rogers 4350 and has a dielectric constant of approximately 3.45, a thickness of approximately 0.030 inches, and a loss tangent of approximately 0.004. Although substrate 16*d* is described as including a particular material and having a particular dielectric constant, a particular thickness, and a particular loss tangent, substrate 16*d* could comprise any suitable material and have any suitable dielectric constant, any suitable thickness, and any suitable loss tangent. Strip 12*d* comprises copper. Although strip 12*d* is described as including copper, strip 12*d* could comprise any suitable material.

Figure 8B:
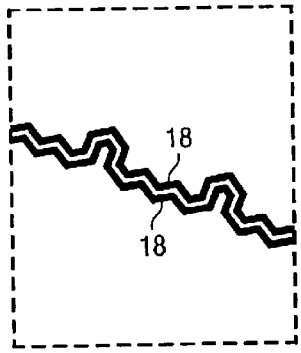

Strip 12*d* comprises four sections 18 that run parallel to each other, and each section 18 of strip 12*d* has been meandered according to a fractal curve 30 that is similar to fractal curve 30*c*, but that includes inside angles 34 that are each approximately equal to 120 degrees. FIG. 8B illustrates a portion of strip 12*c* in detail. The portion of strip 12*c* illustrated in FIG. 8B comprises two sections 18. Both sections 18 have been meandered according to fractal curve 30. Like each section 18 of meandered-line bandpass filter 36*a*, each section 18 of meandered-line bandpass filter 36*b* has a width 24 of approximately 0.005 inches and is separated from an adjacent section 18 by a distance 20 of approximately 0.008 inches.

Although two sections 18 of meandered-line bandpass filter 36*c* that are adjacent to each other are described and illustrated as being separated from each other by a particular distance 20, two sections 18 of meandered-line bandpass filter 36*c* that are adjacent each other could be separated from each other by any suitable distance 20. In addition, a first distance 20 separating a first pair of adjacent sections 18 of meandered-line bandpass filter 36*c* from each other could be approximately the same as or different from a second distance 20 separating a second pair of adjacent sections 18 of meandered-line bandpass filter 36*c* from each other. Although a section 18 of meandered-line bandpass filter 36*c* is described and illustrated as having a particular length 22, section 18 could have any suitable length 22. In addition, a first length 22 of a first section 18 of meandered-line bandpass filter 36*c* could be approximately the same as or different from a second length 22 of a second section 18 of meandered-line bandpass filter 36*c*. Although a section 18 of meandered-line bandpass filter 36*c* is described and illustrated as having a particular width 24, section 18 could have any suitable width 24. In addition, a first width 24 of a first section 18 of meandered-line bandpass filter 36*c* could be approximately the same as or different from a second width 24 of a second section 18 of meandered-line bandpass filter 36*c*. In addition, a first width 24 of a first section 18 of meandered-line bandpass filter 36*c* could be approximately the same as or different from a second width 24 of a second section 18 of meandered-line bandpass filter 36*c*.

Figure 9:
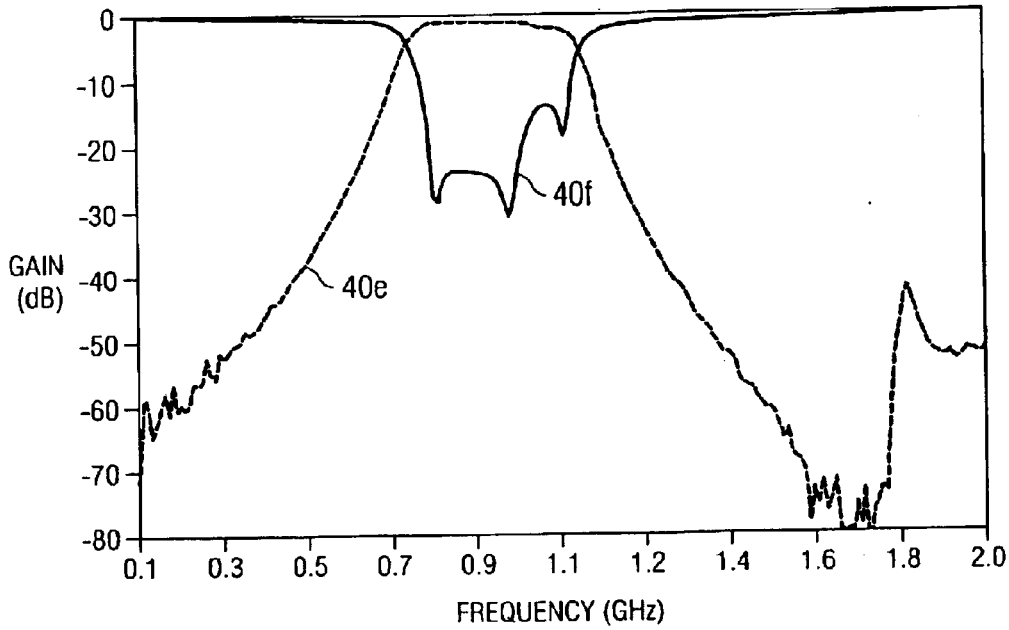
FIG. 9 illustrates an exemplary response of the meandered-line bandpass filter illustrated in FIG. 8.

FIG. 9 illustrates an exemplary response of meandered-line bandpass filter 36*c*. Trace 40*e* indicates the insertion loss of meandered-line bandpass filter 36*c*, and trace 40*f* indicates the return loss of meandered-line bandpass filter 36*c*. According to trace 40*e*, meandered-line bandpass filter 36*c* has a passband that has a lower limit of approximately 0.75 GHz and an upper limit of approximately 1.13 GHz. The response of meandered-line bandpass filter 36*c* at the second harmonic lies at around approximately 1.8 GHz, and the rejection at the second harmonic passband is approximately equal to 41 dB.

Figure 10:
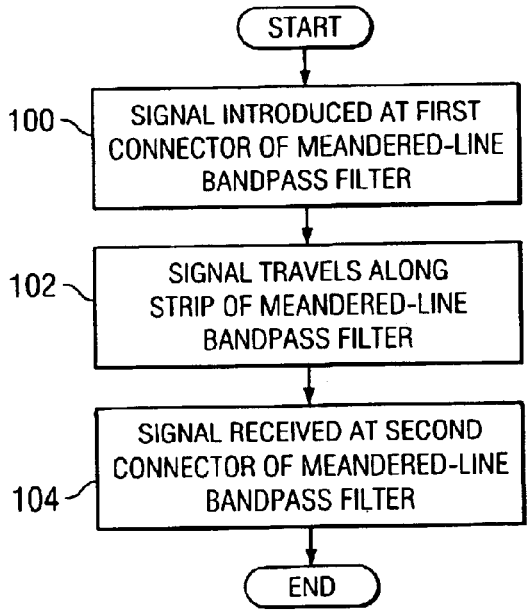
FIG. 10 illustrates an exemplary method for using a meandered-line bandpass filter.

FIG. 10 illustrates an exemplary method for using a meandered-line bandpass filter 36. The method begins at step 100, where a signal is introduced at a first connector 14 coupled to meandered-line bandpass filter 36. At step 102, the signal travels along a strip 12 of meandered-line bandpass filter 36 from first connector 14 to a second connector 14 coupled to meandered-line bandpass filter 36. At step 104, the signal is received at second connector 14, at which point the method ends. At the second connector, the signal is suppressed to varying degrees at frequencies outside the passband of meandered-line bandpass filter 36.

Although particular embodiments of the present invention have been described and illustrated, one or more changes, substitutions, variations, alterations, or modifications can be suggested to one skilled in the art, and it is intended that the present invention encompass all changes, substitutions, variations, alterations, and modifications that fall within the spirit and scope of the appended claims.

What is claimed is:

1. A meandered-line bandpass filter comprising:

a parallel coupled line bandpass filter comprising:

a length and one or more corners, each of the corners being associated with a reactance that affects propagation of an electromagnetic wave alone the length of the parallel coupled line bandpass filter; and a fractal curve along the length of the parallel coupled line bandpass filter.

2. The meandered-line bandpass filter of claim 1, wherein the fractal curve comprises a first iteration, a second iteration, or a third iteration.

3. The meandered-line bandpass filter of claim 1, wherein the fractal curve comprises a modified Koch curve comprising five segments and four inside angles.

4. The meandered-line bandpass filter of claim 3, wherein the inside angles are each approximately equal to 135 degrees.

5. The meandered-line bandpass filter of claim 1, wherein the fractal curve comprises a plurality of inside angles and a plurality of segments that each have a length, at least one of the inside angles being approximately different from another one of the inside angles and at least one of the lengths being approximately different from another one of the lengths.

6. The meandered-line bandpass filter of claim 1, wherein the fractal curve comprises a plurality of inside angles and a plurality of segments that each have a length, the inside angles being approximately equal to each other and the lengths being approximately equal to each other.

7. The meandered-line bandpass filter of claim 1, wherein the fractal curve comprises two or more segments and one or more inside angles that are each associated with a reactance, one or more of the inside angles each being at least partially embedded in a material that has a dielectric constant that affects the reactance associated with the inside angle.

8. The meandered-line bandpass filter of claim 1, wherein the parallel coupled line bandpass filter comprises a plurality of sections.

9. The meandered-line bandpass filter of claim 1, wherein the parallel coupled line bandpass filter comprises a plurality of sections, each section having a length and a width, two of the sections that are adjacent each other being separated from each other by a distance, the lengths being approximately equal to each other, the widths being approximately equal to each other, and the distances being approximately equal to each other.

10. The meandered-line bandpass filter of claim 1, wherein the parallel coupled line bandpass filter comprises a plurality of sections, each section having a length and a width, two of the sections that are adjacent each other being separated from each other by a distance, at least one of the lengths being approximately different from another one of the lengths, at least one of the widths being approximately different from another one of the widths, and at least one of the distances being approximately different from another one of the distances.

11. The meandered-line bandpass filter of claim 1, wherein the parallel coupled line bandpass filter comprises a conductive element that comprises copper.

12. The meandered-line bandpass filter of claim 1, wherein the parallel coupled line bandpass filter lies on a substrate that comprises FR-4 or Rogers 4350.

13. A method for using a meandered-line bandpass filter, the method comprising:

receiving an electromagnetic wave that has propagated along a length of a parallel coupled line bandpass filter, the parallel coupled line bandpass filter comprising:

one or more corners that are each associated with a reactance that affects the propagation of the electromagnetic wave along the length of the parallel coupled line bandpass filter; and a fractal curve along the length of the parallel coupled line bandpass filter.

14. The method of claim 13, wherein the fractal curve comprises a first iteration, a second iteration, or a third iteration.

15. The method of claim 13, wherein the fractal curve comprises a modified Koch curve comprising five segments and four inside angles.

16. The method of claim 15, wherein the inside angles are each approximately equal to 135 degrees.

17. The method of claim 13, wherein the fractal curve comprises a plurality of inside angles and a plurality of segments that each have a length, at least one of the inside angles being approximately different from another one of the inside angles and at least one of the lengths being approximately different from another one of the lengths.

18. The method of claim 13, wherein the fractal curve comprises a plurality of inside angles and a plurality of segments that each have a length, the inside angles being approximately equal to each other and the lengths being approximately equal to each other.

19. The method of claim 13, wherein the fractal curve comprises two or more segments and one or more inside angles that are each associated with a reactance, one or more of the inside angles each being at least partially embedded in a material that has a dielectric constant that affects the reactance associated with the inside angle.

20. The method of claim 13, wherein the parallel coupled line bandpass filter comprises a plurality of sections.

21. The method of claim 13, wherein the parallel coupled line bandpass filter comprises a plurality of sections, each section having a length and a width, two of the sections that are adjacent each other being separated from each other by a distance, the lengths being approximately equal to each other, the widths being approximately equal to each other, and the distances being approximately equal to each other.

22. The method of claim 13, wherein the parallel coupled line bandpass filter comprises a plurality of sections, each section having a length and a width, two of the sections that are adjacent each other being separated from each other by a distance, at least one of the lengths being approximately different from another one of the lengths, at least one of the widths being approximately different from another one of the widths, and at least one of the distances being approximately different from another one of the distances.

23. The method of claim 13, wherein the parallel coupled line bandpass filter comprises a conductive element that comprises copper.

24. The method of claim 13, wherein the parallel coupled line bandpass filter lies on a substrate that comprises FR-4 or Rogers 4350.

25. A meandered-line bandpass filter comprising:

a parallel coupled line bandpass filter that comprises a length and a fractal curve along the length of the parallel coupled line bandpass filter, the fractal curve comprising a third iteration of a modified Koch curve, the modified Koch curve comprising five segments and four inside angles, each of the inside angles being associated with a reactance that affects propagation of an electromagnetic wave along the length of the parallel coupled line bandpass filter.

* * * * *

UNITED STATES PATENT AND TRADEMARK OFFICE

CERTIFICATE OF CORRECTION

PATENT NO. : 6,885,264 B1
APPLICATION NO. : 10/383367
DATED : April 26, 2005
INVENTOR(S) : Vincent et al.

It is certified that error appears in the above-identified patent and that said Letters Patent is hereby corrected as shown below:

Column 1, Line 35, after “associate with”, delete “with bandpass filters.”, and insert -- multicasting in a high-speed switching environment. --.
Column 2, Line 12, after “bandpass filter”, delete “,”, and insert -- ; --.
Column 3, Line 53, after “curve 30a”, insert -- . --.
Column 4, Line 25, after “filter 36a”, insert -- . --.
Column 6, Line 63, after “comprises”, delete “FR4”, and insert -- FR-4 --.
Column 9, Line 15, after “wave”, delete “alone”, and insert -- along --.

Signed and Sealed this

Thirteenth Day of February, 2007

JON W. DUDAS
*Director of the United States Patent and Trademark Office*